United States Patent [19]

Hunter

[11] 4,261,785

[45] Apr. 14, 1981

[54] APPARATUS FOR CLEANING AND WRAPPING CONTINUOUS BODIES

[76] Inventor: John J. Hunter, 1410 Willow Pond, Abilene, Tex. 79602

[21] Appl. No.: 58,819

[22] Filed: Jul. 19, 1979

[51] Int. Cl.[3] ..... B65H 81/08

[52] U.S. Cl. ..... 156/392; 493/291; 493/300; 493/381

[58] Field of Search ..... 93/77 CL, 77 R, 80, 93/94 R; 156/392, 425, 428

[56] References Cited

U.S. PATENT DOCUMENTS

| | | | |
|---|---|---|---|
| 2,888,694 | 6/1959 | Betzel, Sr. | 156/392 X |
| 3,470,057 | 9/1969 | Stuart, Jr. et al. | 156/392 |
| 3,864,191 | 2/1975 | Tovarys | 156/468 |
| 3,994,766 | 11/1976 | Dedels | 156/392 |
| 4,113,545 | 9/1978 | Stuart, Jr. et al. | 156/392 |

*Primary Examiner*—James F. Coan

*Attorney, Agent, or Firm*—Kanz & Timmons

[57] ABSTRACT

Disclosed is a pipe wrapper and cleaner or similar apparatus which includes a rotatable drum with an axial linear slot or gap therein which may be supported on and rotated about an elongated body such as a pipe by casters carried by the drum and engaging the elongated body to support the drum concentrically thereabout. An outwardly projecting flange encircles the drum with a gap therein coincident with the gap in the drum. The drum is rotated by a pair of drive gears powered by synchronous motors and placed circumferentially apart by an arcuate distance greater than the arcuate length of the gap in the flange.

12 Claims, 6 Drawing Figures

APPARATUS FOR CLEANING AND WRAPPING CONTINUOUS BODIES

This invention relates to apparatus for cleaning, wrapping or otherwise treating the external surface of a continuous body such as a string of pipe or the like. More particularly, it relates to powered rotating apparatus which may be readily mounted concentrically about and removed from a continuous elongated body such as a string of pipe or the like as desired for cleaning and/or wrapping the external surface of such elongated continuous body.

Many elongated continuous bodies, such as strings of pipe and the like, require that wrappings be applied to their external surfaces for various reasons. For example, the surface of buried pipe may be wrapped for insulation or to protect the pipe from corrosion. Likewise, exposed or buried pipe may be wrapped to electrically or thermally insulate the pipe from its surrounding environment. In many cases it is desirable or even necessary that the external surface of a pipe or other elongated body be cleaned prior to application of a wrapping, other coating or for other reasons.

Conventional wrapping apparatus generally comprises a rotating drum or the like which surrounds the elongated body and carries a continuous roll of wrapping material. The end of the wrapping material is attached to the elongated body and the drum rotated thereabout. Simultaneously, the drum is moved axially with respect to the elongated body, thus applying a continuous wrapping to the elongated body. Ordinarily the drum is rotated about the elongated body because the elongated body is not readily rotatable. Therefore, means must be provided for rotating the drum.

Since rotationally stationary drive means must be provided for rotating the drum, the drum is ordinarily a cylindrical body rotationally driven by a belt encircling the drum and driven by a motor drive means. Therefore, the wrapping drum can only be assembled about an elongated body by passing one end of the elongated body through the drum. Difficulty is encountered when the wrapping apparatus must be used in connection with an endless elongated body such as endless loop, an elongated rod with both ends secured to other apparatus or a line of pipe or the like. In such cases, the wrapping drum must be divided axially so that the drum may be disassembled and reassembled surrounding the elongated body. Such apparatus is usually cumbersome and difficult to use. Furthermore, valuable time is expended in the disassembly and reassembly operations, particularly where the apparatus is used to wrap pipe having a plurality of interconnections, valves or the like in the line.

In accordance with the present invention apparatus is provided which includes a rotatable cylindrical open-ended drum surrounding the body to be wrapped. The drum, however, has an axial gap of sufficient arcuate length to permit the drum to be positioned surrounding an endless elongated body without disassembly of any portion of the drum or drum drive apparatus. The drum is rotated by a pair of synchronous hydraulic motors circumferentially spaced apart a sufficient distance to bridge the gap and thereby supply continuous rotary drive power to the drum. A removeable plate is provided to occupy the gap space and form a complete cylindrical drum if desired. However, the apparatus may be operated without the removeable plate. Thus a rotatable wrapping or cleaning drum is provided with a axial opening in the periphery thereof which may be positioned as desired on an endless body and immediately operated to rotate about the body to clean or wrap the endless body. The apparatus may be adapted to support spools of wrapping material or cleaning brushes as desired to clean or wrap the endless body.

Other features and advantages of the invention will become more readily understood from the following detailed description taken in connection with the appended claims and attached drawings in which:

It will be readily appreciated that various types of continuous elongated bodies, such as strings of pipe or tubing, metallic and non-metallic, as well as elongated solid bodies or continuous loops thereof may require external cleaning and/or wrapping. For purposes of simplicity and clarity of illustration, the invention will be described herein with reference to apparatus for cleaning the external surface of and/or applying an external wrapping to a continuous string of pipe. The invention, however, is not so limited and, as will be understood by those skilled in the art, the principles thereof may be applied to various apparatus for cleaning and/or coating elongated continuous bodies of various types.

Figure 1:
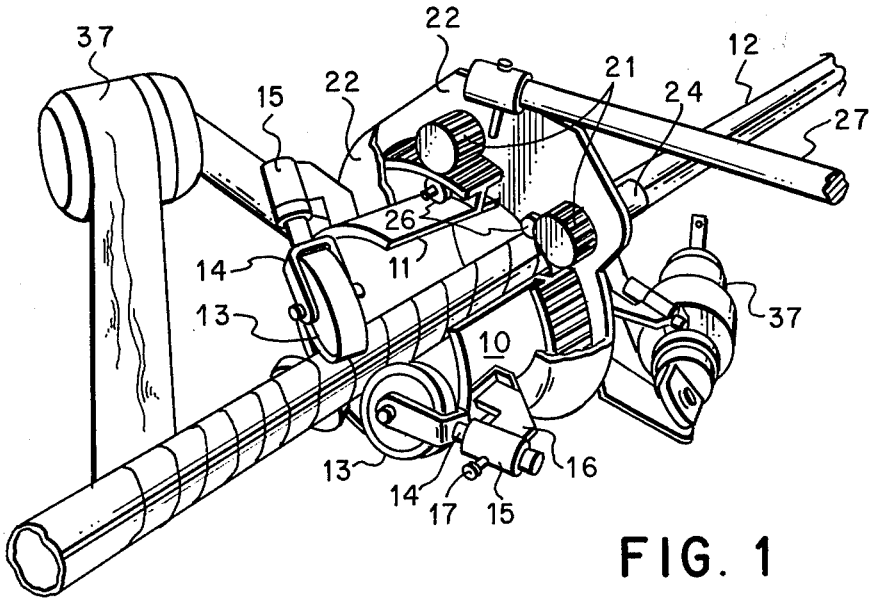
FIG. 1 is a perspective view of the preferred embodiment of the wrapping apparatus of the invention.

The preferred embodiment of the apparatus of the invention, as illustrated in FIG. 1, comprises an open-ended cylindrical housing or drum 10 with a portion thereof removed to define an axially linear gap 11 in the wall thereof. The axially linear gap 11 in the wall may comprise as much as 90° of arc or more, depending upon the circumference of drum 10 and the external diameter of the pipe around which the drum is to be positioned. The gap 11 should, of course, be no larger than necessary to accommodate the largest external diameter pipe to which the wrapping apparatus is to be attached. It will thus be observed that the drum may be positioned to surround an endless pipe by passing the pipe through the gap 11.

The drum 10 is supported coaxial with the pipe 12 by a plurality of casters 13 carried by the drum 10. Each caster 13 is journalled within a forked shaft 14 adjustably secured within a shaft collar 15. Shaft collars 15 are fixedly attached to the housing 10 by brackets 16. In the preferred embodiment three brackets 16 are employed at each end of the housing 10 and positioned 120° part around the circumference thereof. The collars 15 are aligned with their axes lying along radius lines 90° from the axis of the housing 10 and pipe 12. Shafts 15 are adjustably secured within brackets 16 by means of set screws 17 so that the casters 13 engage the pipe 12 and maintain the cylindrical housing 10 coaxial with the pipe 12. Accordingly, the cylindrical housing 10 may rotate concentrically about the pipe 12 with the casters 13 riding on the pipe 12. Shafts 14 may be rotated in collars 15 so that upon rotation of the drum 10 the apparatus also moves axially over the pipe 12, the rate of axial movement being determined by the degree of rotation of shafts 14 in collars 15.

Figure 6:
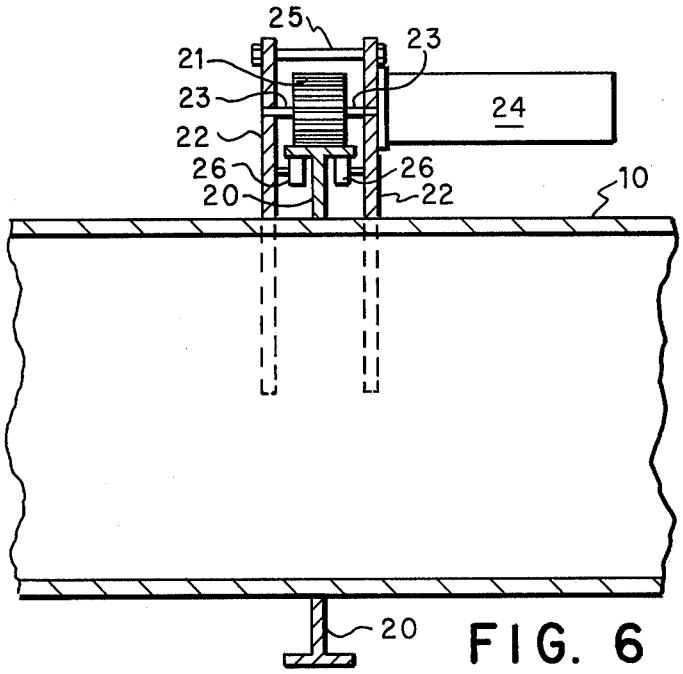
FIG. 6 is a partial sectional detail of the rotating drum illustrating the rotating mechanism.

A radially outwardly projecting flange 20 (See FIG. 6) is secured to and surrounds the central portion of the cylindrical drum 10. Flange 20 has a gap therein coincident with the gap 11 in the housing and is T-shaped in cross section as illustrated in FIG. 6.

The drum 10 is rotated by a pair of gears 21 engaging the toothed outer surface of the T flange 20. As illustrated in FIG. 6, the gears 21 are positioned between a pair of semi-circular plates 22 and rotated by shafts 23 driven by synchronous hydraulic motors 24. The plates 22 partially surround the drum 10 parallel with flange 20 and are spaced apart and rigidly secured to each other by bolts 25 to form a housing partially enclosing the T flange 20 and partially surrounding the drum 10. Each plate 22 carries at least three guide rollers 26 which engage the underside of the T on flange 20 and maintain the flange 20 in contact with drive gears 21. The guide rollers 26 are arranged in opposing pairs and spaced circumferentially so that at least two guide roller pairs are in contact with the flange 20 at all times. Likewise, the drive gears 21 are spaced circumferentially so that the arcuate distance between the drive gears 21 is greater than the arcuate length of gap 11. Accordingly, at least one drive gear 26 is engaged with the flange 20 at all times.

The guide rollers 26 maintain the flange 20 in uniform contact with the drive gears 21 and support the housing formed by plates 22 so that the flange 20 may rotate through the housing formed by the plates 22. While in the preferred embodiment illustrated, the top of the T passes between the drive gears 21 and the guide rollers 26, the flange may be of other configurations and accomplish the same result. For example, the flange may be L-shaped with axially projecting rollers provided to maintain axial alignment of the drive housing and the flange. Likewise, the underside of the flange may be provided with a gear receiving track and the guide rollers positioned on the outer surface of the flange. Various other modifications may, of course, be used. The drive motors 24 are preferably identical hydraulic motors with the exit port of one motor connected to the inlet port of the other motor. Accordingly, the motors are driven at substantially identical speeds. Therefore, when the drum 10 is rotated until one drive gear is positioned within the gap 11, the other drive gear continues to uniformly rotate the drum 10 until after the first gear has passed the gap and again engaged the flange 20. Accordingly, the drum is continuously and uniformly rotated even though the drum and flange 20 have a substantial gap 11 therein. Where only three pairs of guide rollers 26 are employed, the gears 21 should be placed intermediate the guide rollers.

It will be appreciated, however, that since the plates 22 extend only partially around the drum 10, the drum may be rotated until the gap 11 is opposite the plates 22 and, upon removal of one of the casters 13, be immediately removed from the pipe 12.

A handle 27 is attached to the plates 22 and extends laterally therefrom. Since the drum 10 is wholly supported on the pipe 12 by the casters 13 and the plates 22 carry the hydraulic drive motors, rotary motion is imparted to the drum when the motors 24 are activated and the handle 27 held rotationally stationary with respect to the drum 10. For convenience, the controls (not shown) for motors 24 may be carried on the handle 27. Since the motors are operated in series with the output from one motor connected to the input of the other motor, only a single power line controlled by a single control lever is required.

Figure 2:
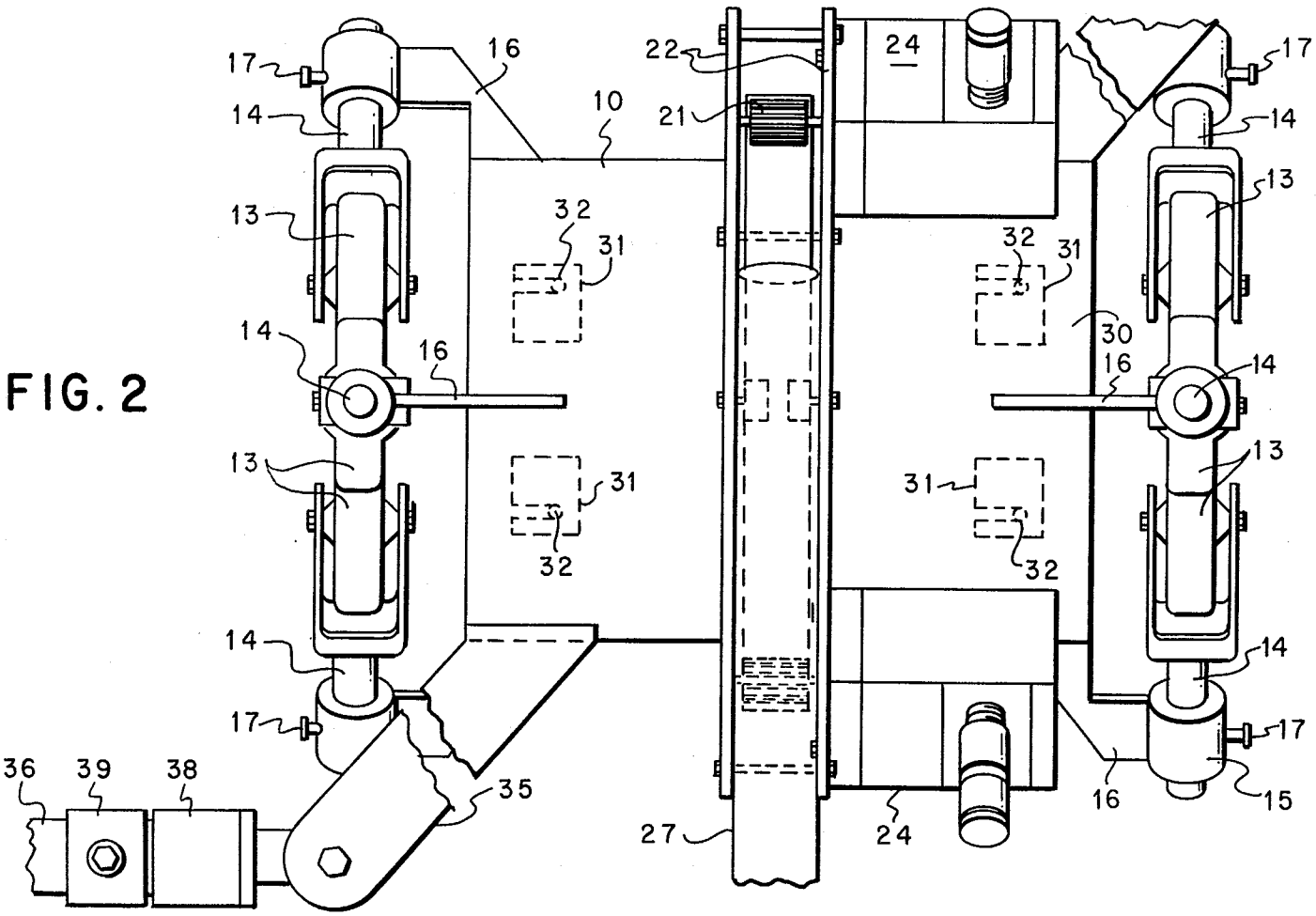
FIG. 2 is an elevational view of the apparatus of FIG. 1 showing the placement of a removeable plate to occupy the gap in the drum.
Figure 3:
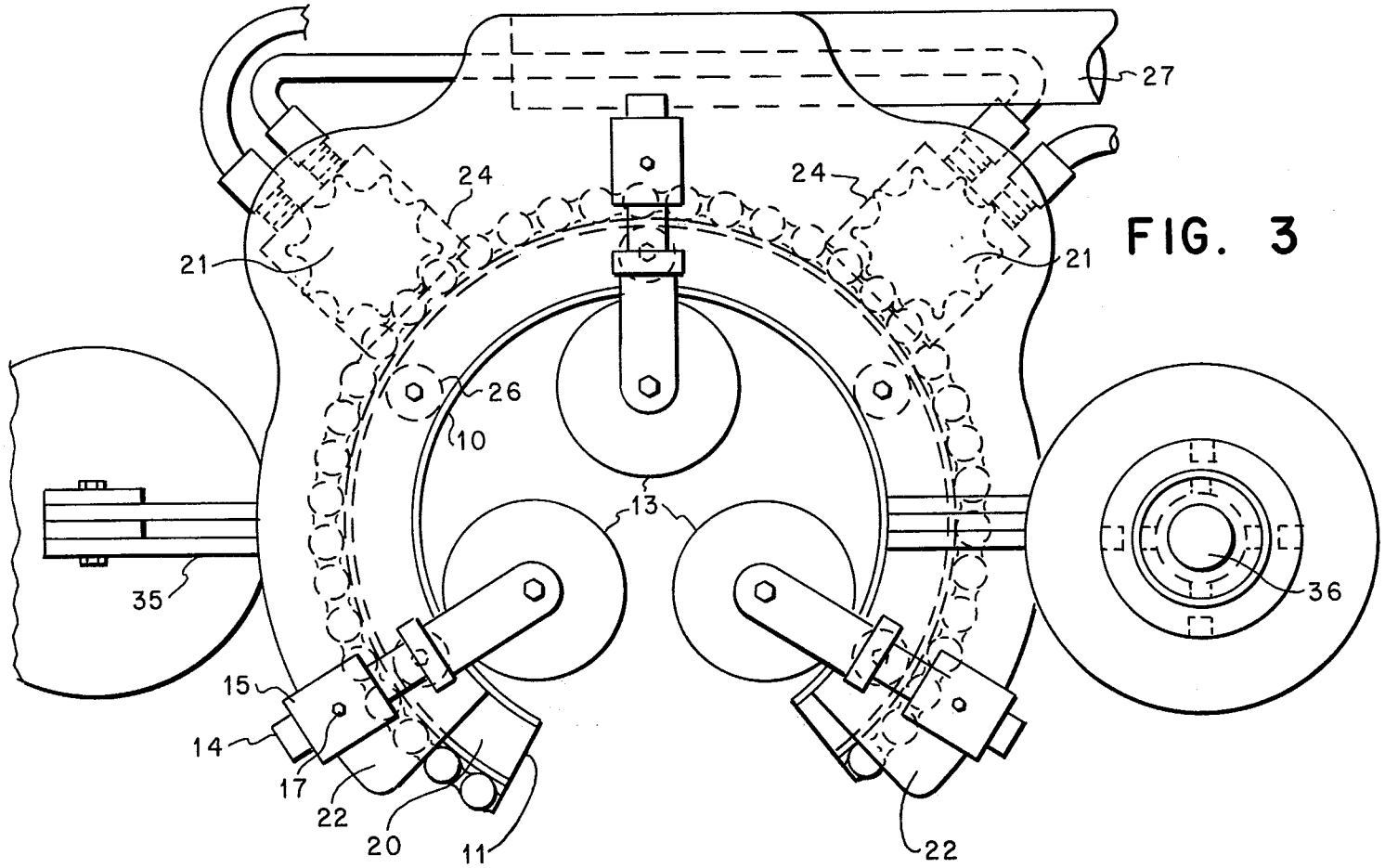
FIG. 3 is an end view of the apparatus of FIG. 1.

As illustrated in FIG. 2, a curved plate 30 adapted to fill gap 11 may be provided. Slotted tabs 31 extending laterally from the plate 30 mate with studs 32 in the drum 10 to secure the plate 30 in the gap. The plate 30 carries a section of T flange to fill the corresponding gap in T flange 20 so that when the plate 30 is installed, the T flange completely encircles the drum 10.

To operate as a wrapping apparatus, the drum 10 carries at least one bracket 35 which extends from the open end of the drum to support an adjustably mounted shaft 36. The shaft 36 supports a spool of wrapping material 37 as illustrated in FIG. 1. In the preferred embodiment, the shaft 36 carries a friction clutch 38 against which the spool is maintained by backing collar 39. Thus backing collar 39 may be adjusted to vary the tension on the wrapping material in conventional fashion. If desired, the drum 10 may carry a plurality of such spools on additional brackets as illustrated in FIG. 1 to apply multiple wrappings on a single pass over the pipe.

Figure 4:
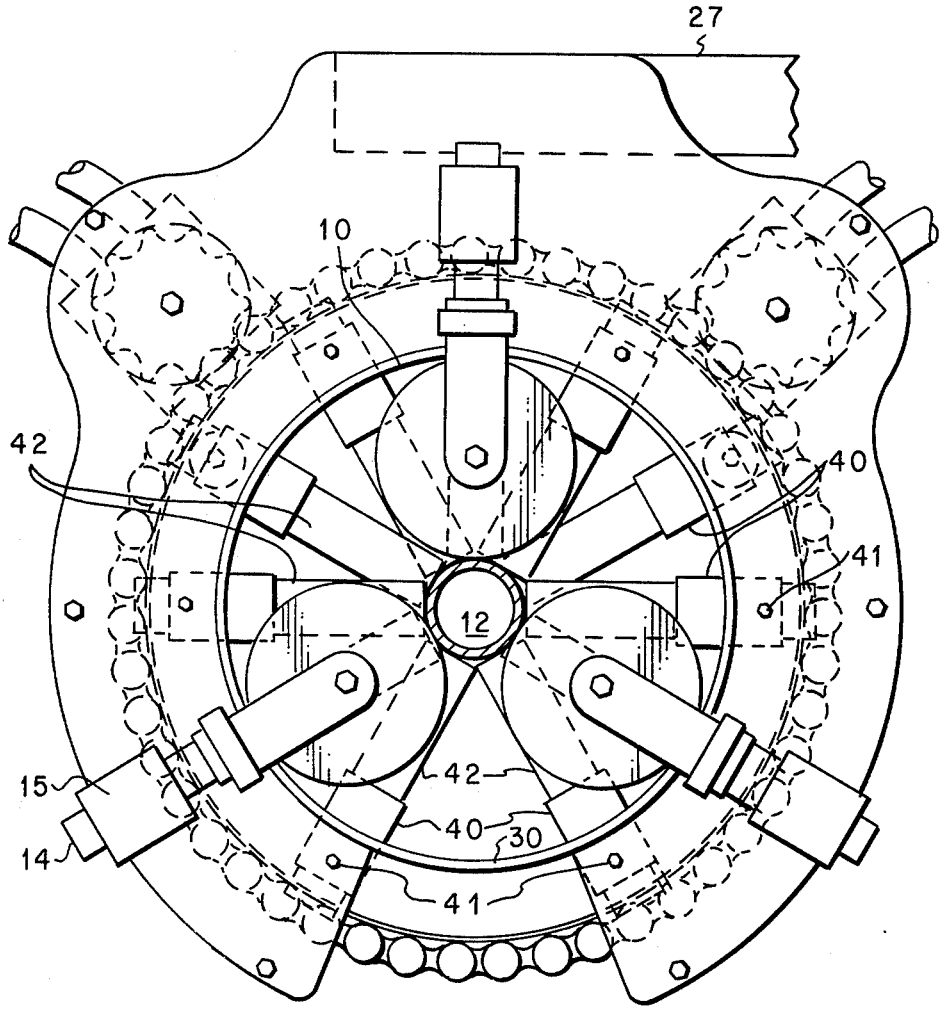
FIG. 4 is an end view of the apparatus of the invention adapted for use as a cleaner.
Figure 5:
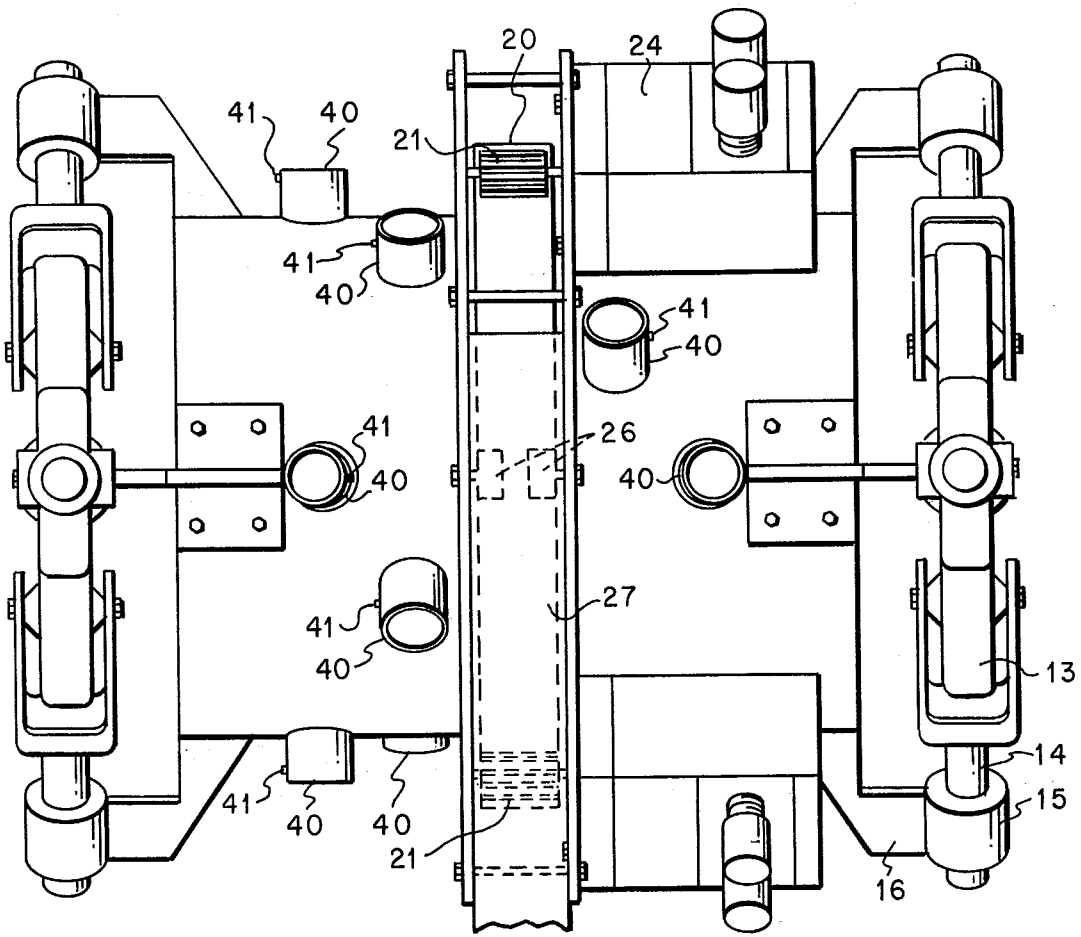
FIG. 5 is an elevational view of the apparatus of FIG. 4.

An alternative embodiment of the invention is illustrated in FIGS. 4 and 5. In this embodiment the rotating drum 10 as described hereinabove carries a plurality of cylindrical channels 40 projecting radially through the drum 10. Cleaning brushes 42 are secured within channels 40 by screws 41 and project radially into the drum 10 to contact the outer surface of pipe 12. Thus as the drum 10 is rotated about the pipe 12, the brushes 42 clean the surface of the pipe. In the preferred embodiment, lengths of steel cable may be used as cleaning brushes 42. Various other brush means or other cleaning devices may, of course, be used.

While the apparatus of the invention described in detail carries one or more brushes for cleaning and/or one or more spools of wrapping material for coating a pipe, it will be readily appreciated that the apparatus for rotating about an elongated body described herein may be used to apply various other treatment to the continuous body. For example, the rotating drum may carry means for spraying cleaning or coating materials on the elongated body or may carry other apparatus for treating the elongated body as desired. Likewise, while the apparatus has been described with particular reference to synchronous hydraulic motors, other synchronous drive means, such as synchronous electric drive motors may also be used. It is to be understood, therefore, that although the invention has been described with particular reference to specific embodiments thereof, the forms of the invention shown and described in detail are to be taken as preferred embodiments thereof, and that various changes and modifications may be resorted to without departing from the spirit and scope of the invention as defined by the appended claims.

What is claimed:

1. Apparatus for rotating about an elongated continuous body comprising:

(a) an open-ended cylindrical drum having an axially linear gap traversing the length thereof;

(b) a plurality of casters projecting radially inwardly from each end of said drum and adapted to engage the surface of an elongated body positioned coaxially within said drum, thereby to support said drum concentrically about said elongated body;

(c) a drive flange attached to and encircling said drum having a gap therein coincident with the gap in said drum; and (d) drive means engaging said drive flange, said drive means including two synchronous drive gears driven by substantially identical hydraulic motors with the drive fluid input of one of said hydraulic motors connected to the drive fluid output of the other hydraulic motor with said drive gears engaging said drive flange and spaced apart by an arcuate distance greater than the arcuate length of said gap in said drum.

2. Apparatus as defined in claim 1 wherein said drive flange includes track means for engaging drive gear means, and said drive means includes a housing supporting said hydraulic motors with said hydraulic motors attached to drive gears engaging said track means circumferentially separated by a greater distance than the arcuate length of said gap, said housing further including a plurality of guide rollers engaging said flange to support said housing in fixed relation with said drum.

3. Apparatus as defined in claim 2 wherein said drive flange comprises a flange member T-shaped in cross section with said track means for engaging said drive gear means on the outer surface thereof and wherein said guide rollers are arranged in pairs, one roller of each pair positioned on opposite sides of said T-shaped flange and engaging the underside of the top of said T-shaped flange.

4. Apparatus as defined in claim 1 including bracket means attached to said drum supporting means for applying a wrapping material to said elongated body as said drum is rotated about said elongated body.

5. Apparatus as defined in claim 1 including means for supporting brush means within said drum for cleaning the surface of said elongated body as said drum is rotated about said elongated body.

6. Apparatus as defined in claim 5 wherein said means for supporting brush means comprises a plurality of channels extending radially through said drum and said brush means comprises lengths of steel cable secured within said channels.

7. Apparatus as defined in claim 3 including at least three pairs of said guide rollers, each of said pairs of guide rollers circumferentially separated from the nearest set of guide rollers by an arcuate distance greater than the arcuate length of said gap.

8. Apparatus as defined in claim 7 wherein said each of said drive gears is positioned circumferentially intermediate consecutive nearest pairs of said guide rollers.

9. Apparatus for rotating about an elongated continuous body comprising:

(a) an open-ended cylindrical drum having an axially linear gap traversing the length thereof;

(b) a plurality of casters projecting radially inwardly from each end of said drum and adapted to engage the surface of an elongated body positioned coaxially within said drum, thereby to support said drum concentrically about said elongated body;

(c) a drive flange attached to and encircling said drum having a gap therein coincident with the gap in said drum;

(d) drive means engaging said drive flange, said drive means including two synchronous drive gears engaging said drive flange and spaced apart by an arcuate distance greater that the arcuate length of said gap in said drum; and (e) means for supporting brush means within said drum for cleaning the surface of said elongated body as said drum is rotated about said elongated body, said means for supporting brush means comprising a plurality of channels extending radially through said drum and said brush means comprising lengths of steel cable secured within said channels.

10. Apparatus for rotating about an elongated continuous body comprising:

(a) an open-ended cylindrical drum having an axially linear gap traversing the length thereof;

(b) a plurality of casters projecting radially inwardly from each end of said drum and adapted to engage the surface of an elongated body positioned coaxially within said drum, thereby to support said drum concentrically about said elongated body;

(c) a drive flange attached to and encircling said drum having a gap therein coincident with the gap in said drum, said drive flange including track means for engaging drive gear means and a flange member T-shaped in cross section with said track means for engaging said drive gear means on the outer surface thereof; and (d) drive means engaging said drive flange, said drive means including two synchronous drive gears engaging said drive flange and spaced apart by an arcuate distance greater that the arcuate length of said gap in said drum and further including a housing supporting two synchronous drive motors attached to said drive gears engaging said track means circumferentially separated by a greater distance than the arcuate length of said gap, said housing further including a plurality of guide rollers engaging said flange to support said housing in fixed relation with said drum wherein said guide rollers are arranged in pairs, one roller of each pair positioned on opposite sides of said T-shaped flange and engaging the underside of the top of said T-shaped flange.

11. Apparatus as defined in claim 10 including at least three pairs of said guide rollers, each of said pairs of guide rollers circumferentially separated from the nearest set of guide rollers by an arcuate distance greater than the arcuate length of said gap.

12. Apparatus as defined in claim 11 wherein said each of said drive gears is positioned circumferentially intermediate consecutive nearest pairs of said guide rollers.

* * * * *